US007270173B2

(12) United States Patent
Wiedemer et al.

(10) Patent No.: US 7,270,173 B2
(45) **Date of Patent: *Sep. 18, 2007**

(54) COMPOSITE CORE FOR USE IN PRECISION INVESTMENT CASTING

(75) Inventors: John D. Wiedemer, Glastonbury, CT (US); Keith A. Santeler, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 1 day.

This patent is subject to a terminal disclaimer.

(21) Appl. No.: 11/522,738

(22) Filed: Sep. 18, 2006

(65) Prior Publication Data

US 2007/0144702 A1 Jun. 28, 2007

Related U.S. Application Data

(63) Continuation of application No. 10/937,067, filed on Sep. 9, 2004, now Pat. No. 7,108,045.

(51) Int. Cl.
*B22C 9/10* (2006.01)

(52) U.S. Cl. ..... 164/369

(58) Field of Classification Search ..... 164/361, 164/365, 368, 369, 370

See application file for complete search history.

(56) References Cited

U.S. PATENT DOCUMENTS

| | | | | |
|---|---|---|---|---|
| 6,637,500 | B2 * | 10/2003 | Shah et al. | 164/369 |
| 6,929,054 | B2 * | 8/2005 | Beals et al. | 164/369 |
| 7,108,045 | B2 * | 9/2006 | Wiedemer et al. | 164/369 |
| 2003/0075300 | A1 * | 4/2003 | Shah et al. | 164/369 |

* cited by examiner

*Primary Examiner*—Kevin P. Kerns
(74) *Attorney, Agent, or Firm*—Marjama & Bilinski LLP

(57) ABSTRACT

A composite core for an investment casting process, the core including both a ceramic portion and a refractory metal portion, with the refractory metal portion being so disposed as to perform the function of a plurality of such refractory metal elements. In particular, a refractory metal element attached to a trailing edge of a ceramic element extends beyond the plane of a tip end of the ceramic element so as to replace the refractory metal element otherwise extending from the ceramic tip edge. The refractory metal element also extends beyond the space to be occupied by the wax casting, both in the direction of the tip end and the trailing edge such that improved placement and securing of the core is facilitated during the casting process. A further embodiment uses a single refractory metal element that extends into both the airfoil portion and an orthogonal extending platform portion thereof.

4 Claims, 2 Drawing Sheets

COMPOSITE CORE FOR USE IN PRECISION INVESTMENT CASTING

This application is a continuation of U.S. patent application Ser. No. 10/937,067, now issued as U.S. Pat. No. 7,108,045, assigned to the assignee of the present application.

BACKGROUND OF THE INVENTION

The present invention relates to investment casting cores, and in particular to investment casting cores which are formed of a composite of ceramic and refractory metal components.

Investment casting is a commonly used technique for forming metallic components having complex geometries, such as turbine blades for gas turbine engines which are widely used in aircraft propulsion, electric power generation, and ship propulsion.

In all gas turbine engine applications, efficiency is a prime objective. Improved gas turbine engine efficiency can be obtained by operating at higher temperatures. However current operating temperatures are at such a level that, in the turbine section, the superalloy materials used have limited mechanical properties. Consequently, it is a general practice to provide air cooling for components in the hottest portions of gas turbine engines, typically in the turbine section. Cooling is provided by flowing relatively cool air from the compressor section of the engine through passages in the turbine components to be cooled. It will be appreciated that cooling comes with an associated cost in engine efficiency, and consequently, there is a strong desire to provide enhanced specific cooling to, maximize the amount of cooling benefit obtained from a given amount of cooling air.

While turbine blades and vanes are some of the most important components that are cooled, other components such as combustion chambers and blade outer air seals also require cooling, and the invention has application to all cooled turbine hardware, and in fact to all complex cast articles.

Traditionally cores used in the manufacture of airfoils having hollow cavities therein have been fabricated from ceramic materials, but such ceramic cores are fragile, especially the advanced cores used to fabricate small intricate cooling passages in advanced hardware. Such ceramic cores are prone to warpage and fracture during fabrication and during casting. In some advanced experimental blade designs, casting yields of less than 10% are achieved, principally because of core failure.

Conventional ceramic cores are produced by a molding process using a ceramic slurry and a shaped die; both injection molding and transfer-molding techniques may be employed. The pattern material is most commonly wax, although plastics, low melting-point metals, and organic compounds such as urea, have also been employed. The shell mold is formed using a colloidal silica binder to bind together ceramic particles which may be alumina, silica, zirconia and alumina silicates.

To briefly describe the investment casting process for producing a turbine blade using a ceramic core, a ceramic core having the geometry desired for the internal cooling passages is placed in a metal die whose walls surround but are generally spaced away from the core. The die is filled with a disposable pattern material such as wax. The die is removed, leaving the ceramic core embedded in a wax pattern. The outer shell mold is then formed about the wax pattern by dipping the pattern in a ceramic slurry and then applying larger, dry ceramic particles to the slurry. This process is termed stuccoing. The stuccoed wax pattern, containing the core, is then dried and the stuccoing process repeated to provide the desired shell mold wall thickness. At this point the mold is thoroughly dried and heated to an elevated temperature to remove the wax material and strengthen the ceramic material.

The result is a ceramic mold containing a ceramic core which in combination define a mold cavity. It will be understood that the exterior of the core defines the passageway to be formed in the casting and the interior of the shell mold defines the external dimensions of the superalloy casting to be made. The core and shell may also define casting portions such as gates and risers which are necessary for the casting process but are not a part of the finished cast component.

After the removal of the wax, molten superalloy material is poured into the cavity defined by the shell mold and core assembly and solidified. The mold and core are then removed from the superalloy casting by a combination of mechanical and chemical means such as leaching.

As previously noted, the traditional ceramic cores tend to limit casting designs because of their fragility and limitations regarding acceptable casting yields, especially with cores having small dimensions.

In order to overcome the limitations, the use of refractory metal elements for use in cores was introduced. The refractory metal elements can be used either by themselves or in combination with the ceramic elements to form a composite. This approach is described in U.S. Patent Publication No. US 2003/0075300 A1, now U.S. Pat. No. 6,637,500 which is assigned to the common assignee of the present invention and which is incorporated herein by reference.

One of the problems that has been encountered with use of refractory metal elements is that, as the total number of refractory metal elements is increased, so do the complexities of locating and attaching them to associated ceramic elements. Further, some of these refractory metal elements are small and fragile so as to be easily damaged and thereby reduce the yield rate.

Another problem associated with such composite cores is that of properly locating and maintaining their position within the die prior to the filling of the die with wax. Heretofore this has accomplished by the use of so called "print outs", or handles, which are extensions of the ceramic core which extend beyond the cavity that is to be filled with wax. Generally, the number and locations of these ceramic printouts has been very limited because of the brittleness and fragility of the ceramic material which is necessarily in a cantilevered disposition.

SUMMARY OF THE INVENTION

Briefly, in accordance with one aspect of the invention, the number of refractory metal elements used in the core is reduced by the combining of a plurality of refractory metal elements into a single refractory metal element. In this way, the cost of manufacturing is substantially reduced because of the reduced number of the refractory metal elements and their need to be individually located and attached to associated ceramic elements.

In accordance with another aspect of the invention, refractory metal elements that are small and fragile are replaced by other refractory metal elements that are extended to their locations so as to serve the purpose of both refractory metal elements. In one embodiment, this is accomplished by replacing a refractory metal element from the tip of a ceramic element by extending the refractory metal element at a trailing edge of the ceramic element to extend into that area associated with the tip of the ceramic element.

In accordance with another embodiment of the invention, a refractory metal element can serve as a printout by extending it beyond the area of the cavity in which the wax will be inserted for purposes of making a wax pattern. In one form, plural printouts extend into adjacent edges to thereby enhance the process of locating and holding the core in position during the wax casting process.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
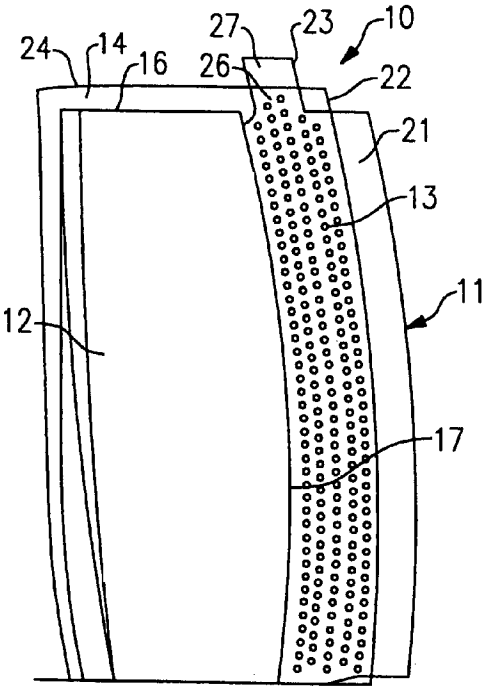
FIG. 1 is a composite core after wax casting in accordance with one embodiment of the invention.

Referring now to FIG. 1, the invention is shown generally at 10 as applied to a composite core 11 which includes a ceramic element 12 and a refractory metal element 13.

As is typical for the investment casting process, the core is placed within a metal die whose molds surround the core and the space therebetween is filled with wax. The die is then removed and the composite core 11 is embedded in a wax pattern 14 as is shown in FIG. 1.

Figure 2:
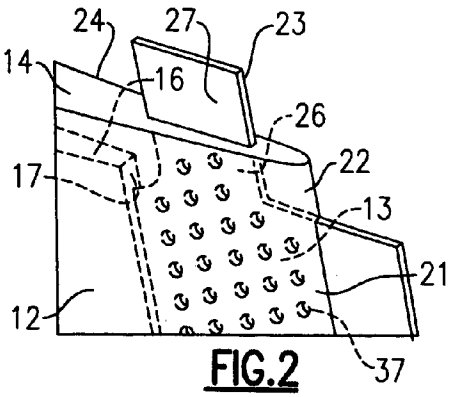
FIG. 2 is an isometric view thereof showing a tip and trailing edge portion thereof.
Figure 3:
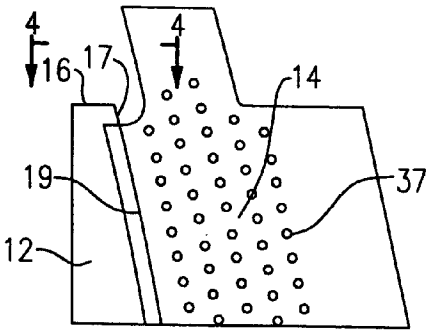
FIG. 3 is a front view of the tip and trailing edge portion thereof prior to casting.
Figure 4:
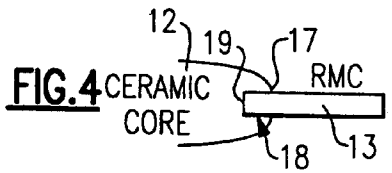
FIG. 4 is a top view thereof.

As will be seen in FIGS. 1-4, the composite core element 11 has a tip edge 16 and an adjacent trailing edge 17. A slot 18 is formed in the trailing edge 17 as shown in FIG. 4 so as to receive a front edge 19 of the refractory metal element 13. The refractory metal element leading edge 19 is secured in the slot 18 by any of various methods such as by an adhesive or the like. FIGS. 3 and 4 show the combination of the ceramic element 12 and the refractory metal element 13 prior to the casting process, and FIGS. 1 and 2 show the combination after the casting process.

As will be seen in FIG. 2, most of the refractory metal element 13 is disposed within the wax pattern 14, but there are portions which extend beyond the wax pattern 14. That is, trailing edge portion 21 extends beyond the trailing edge 22 of the wax pattern 14, and a tip portion 23 extends beyond the tip edge 24 of the wax pattern 14. The trailing edge portion 21 and tip portion 23 are referred to as "printout" and are used for positioning and securing the composite core in position during the casting process. In this regard, it should be recognized that a single refractory metal element 13 provides both a trailing edge portion 21 and a tip portion 23, with the two extending in substantially orthogonal directions, to be used for this purpose. This provides not only improved positioning and holding capabilities but also improved strength capabilities.

As will be seen in FIGS. 1 and 2, the tip portion 23 of the refractory metal element 13 includes a portion 26 which is embedded in the wax pattern 14 and another portion 27 that extends beyond the tip edge 24 of the wax pattern 14. The non-embedded portion 27 serves the purpose of locating and holding the core as described hereinabove. The embedded portion 26 serves as a portion of the ceramic core which, when removed by a leaching process or the like, forms a cavity within the superalloy casting. To understand the significance of this embedded portion 26, reference is made to the prior art design as shown in FIG. 5.

Figure 5:
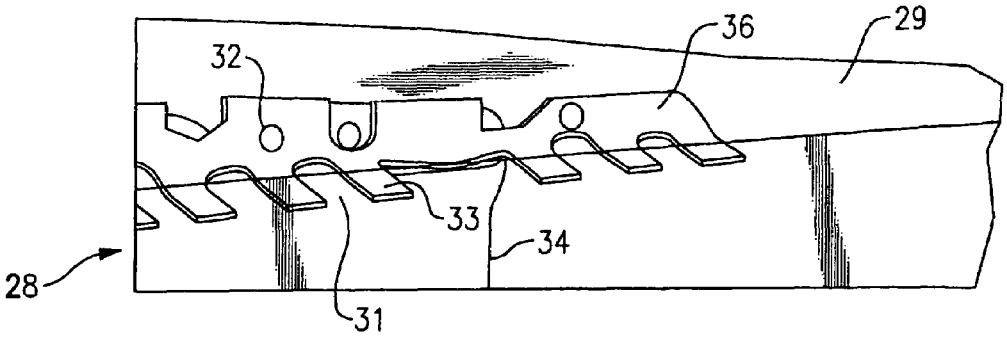
FIG.5 Prior Art
FIG. 5 is a tip portion of a composite core in accordance with the prior art.

As shown in FIG. 5 is a composite core 28 is embedded in a wax pattern 29. The composite core includes a ceramic core element 31 and a refractory metal element 32. The ceramic core element 31 has a tip edge 33 and a trailing edge 34. The refractory metal element 32 is attached to the ceramic core element 31 at its tip edge 33 as shown and has a portion 36 that is cantilevered out over the trailing edge 34 of the ceramic core element 31. It will therefore be seen that the prior art design includes a fragile cantilevered portion 36 which is very susceptible to being damaged during the casting process.

Referring again to the present design as shown in FIGS. 1-4, it will be seen that the refractory metal element 32 of FIG. 5, which was attached to the ceramic element tip edge 33 and included a fragile cantilevered portion 36, was replaced by the embedded portion 26 of the refractory metal element 13 of the present invention. This portion 26 is the robust portion that is disposed between a substantial main body of the refractory metal element 13 and the rather robust non-embedded portion 27 thereof. In this way, the single refractory metal element 13 provides for an extension to the ceramic core element at its trailing edge while, at the same time, extending beyond the tip edge 16 of the ceramic element 12 to replace the refractory metal element 32 which would otherwise project from its tip edge 33.

It should be recognized that the refractory metal element 13 may use any of a variety of shapes to create pedestals, trip strips, pins, fins or other heat transfer enhancement features in the final casting. As shown in FIGS. 1-3, an array of small cylinders 37 project from the main body for this purpose.

Figure 6:
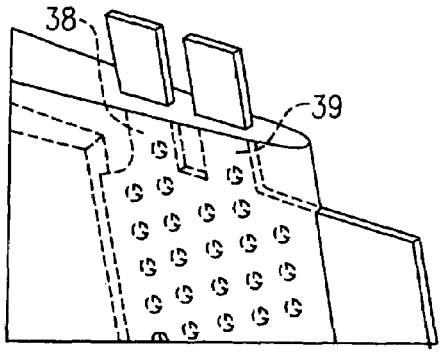
FIG. 6 is an alternate embodiment of the present invention.

As shown in FIGS. 1-3, the tip portion 23 of the refractory metal element 13 is a single projecting element. FIG. 6 shows a variation thereof wherein the tip portion 23 includes a pair of spaced extensions 38 and 39 with each having embedded and non-embedded portions as shown.

Figure 7:
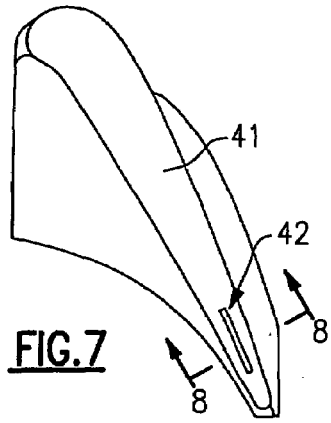
FIG. 7 is an isometric view of an airfoil resulting from use of the present invention.

In the process of forming the airfoil with superalloy materials, after the wax pattern has been removed and replaced with the molten superalloy metal the composite core, including both the ceramic element and the refractory metal element, are removed by a leaching process or the like. The resulting airfoil is as shown in FIG. 7 wherein the airfoil 41 includes a tip exit slot 42 as shown. The cooling air therefore passes into the internal cavity formerly occupied by the refractory metal element 13 and passes out the tip exit slot 42.

Figure 8:
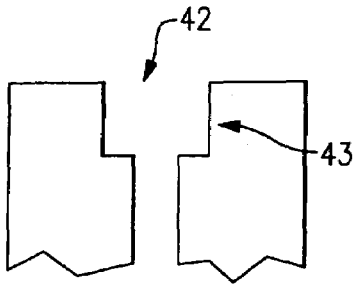
FIG. 8 is a cross sectional view thereof as seen along lines 8-8 of FIG. 7.

In FIG. 8, there is shown a cross section as seen along lines 8-8 of FIG. 7 wherein a counter-bore type feature 43 has been incorporated to reduce the potential for the tip exit slot 42 to become plugged during engine running conditions. (i.e. smearing over of the blade as a result of frictional contact with the mating surface.)

Figure 9:
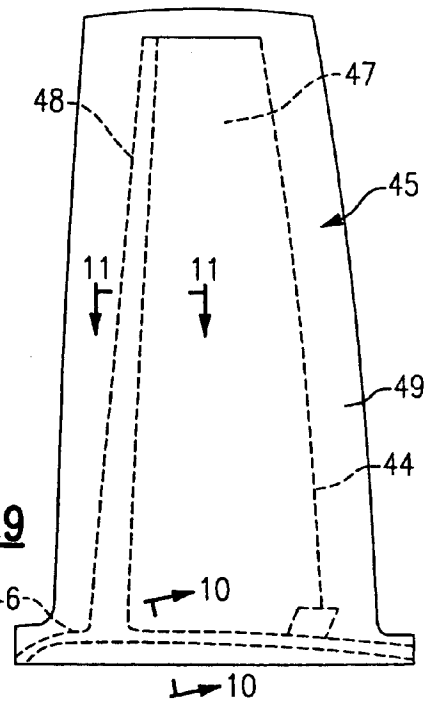
FIG. 9 is an alternative embodiment of the present invention.
Figure 11:
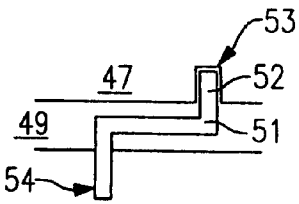
FIG. 11 is a sectional view thereof as seen along lines 11-11 of FIG. 9.
Figure 10:
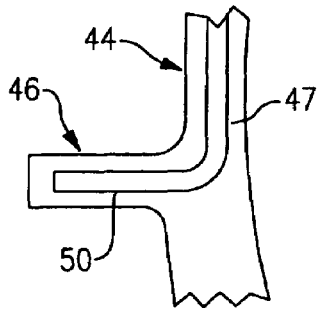
FIG. 10 is a sectional view thereof as seen along lines 10-10 of FIG. 9.

Referring now to FIGS. 9-11, there is shown another embodiment of the present invention wherein a composite core element 45 as shown is incorporated into wax pattern for a blade and has an airfoil portion 44 and a platform portion 46. The platform portion, of course, is that portion which serves to secure the blade to a rotating member such as a disk (not shown). The composite core element 45 includes both a ceramic element 47 and a refractory metal element 48. The combination of the two, which forms the composite core element 45 is embedded within the wax pattern 49.

As will be seen, the ceramic core element 47 is a single element that includes both the airfoil portion 44 and platform portion 46. Further, rather than each of the airfoil portion 44 and platform portion 46 having its individual refractory metal portions, a single L-shaped refractory metal element 50 extends through the airfoil portion 44 of the ceramic core element 47 and then outwardly in an orthogonal direction to pass through the platform portion 46 of the ceramic core element 47 as shown in FIG. 10. In this way a single L-shaped refractory metal element 50 serves on both the airfoil portion 44 and the platform portion 46 such that the final blade will have exit slots on both the platform gas path surfaces as well as on the blade gas path surface. Since the platform leg of the refractory metal element 50 would be tied to the blade portion thereof, the platform portion would be held directly to the ceramic core element 47 for increased casting stability.

As shown in FIG. 11 the refractory metal element 51 has its one end 52 secured in a slot 53 of the ceramic core element 47. The refractory metal element 48 then passes through the wax pattern 49, which will become the airfoil wall, and then projects through the wax pattern 49 to form the extension 54. Subsequently, when the wax pattern 49 has been removed and replaced with the superalloy metal, and the refractory metal element 51 has been leached out, a passage will be left for the flow of cooling air therethrough.

Although the invention has been particularly shown and described with reference to the preferred and alternate embodiments as illustrated in the drawings, it will be understood by one skilled in the art that various changes in detail may be effected therein without departing from the true spirit and scope of the invention as defined by the claims.

We claim:

1. A composite core for use in producing an internal cavity in an investment casting, comprising:

a ceramic element having a tip edge disposed in a plane and a trailing edge;

a refractory metal element attached to said ceramic element trailing edge and extending through said tip edge plane;

wherein said ceramic element comprises a first portion and a second portion, with said first portion extending generally in one direction and said second portion extending in a direction substantially orthogonal thereto, and further wherein said refractory metal element is substantially L-shaped and extends through both said first and said second portions.

2. A composite core as set forth in claim 1 wherein said refractory metal element extends not only through said tip edge plane but also further through a space in which the internal cavity will be disposed upon final casting.

3. A composite core as set forth in claim 1 wherein said refractory metal element extends substantially normally from said ceramic element trailing edge and extends through a space in which the internal cavity will be disposed upon final casting.

4. A composite core as set forth in claim 2 wherein said refractory metal element extends substantially normally from said ceramic element trailing edge and extends through the space in which the internal cavity will be disposed upon final casting.

* * * * *